US007717480B2

(12) United States Patent
Fan

(10) Patent No.: US 7,717,480 B2
(45) Date of Patent: May 18, 2010

(54) LATCH ASSEMBLY

(75) Inventor: Fangchang Fan, Tianjin (CN)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 278 days.

(21) Appl. No.: 11/854,541

(22) Filed: Sep. 12, 2007

(65) Prior Publication Data

US 2009/0064736 A1 Mar. 12, 2009

(51) Int. Cl.
*E05C 1/00* (2006.01)
*E05B 9/00* (2006.01)

(52) U.S. Cl. ..... 292/1.5; 292/337; 292/DIG. 60; 292/DIG. 64

(58) Field of Classification Search ..... 292/1.5, 292/337, DIG. 60, DIG. 64, 1, 169.13, 169.14, 292/169.16, 336.3, 348
See application file for complete search history.

(56) References Cited

U.S. PATENT DOCUMENTS 4,427,224 A * 1/1984 Bergen ..... 292/1.5
4,623,174 A * 11/1986 Trull et al. ..... 292/1.5
4,711,477 A * 12/1987 Fann et al. ..... 292/169.14
4,746,154 A * 5/1988 Fang ..... 292/337
4,890,871 A * 1/1990 Lin ..... 292/337
5,020,837 A * 6/1991 Lin ..... 292/169.13
5,074,605 A * 12/1991 Fann et al. ..... 292/337
RE34,240 E * 5/1993 Lin ..... 292/337
5,490,695 A * 2/1996 Shiue ..... 292/1.5
5,551,736 A * 9/1996 Fann et al. ..... 292/1.5
5,743,573 A * 4/1998 Huang ..... 292/1.5
6,257,630 B1 * 7/2001 Huang ..... 292/1.5
6,293,597 B1 * 9/2001 Huang ..... 292/1.5
6,334,635 B1 * 1/2002 Huang ..... 292/1.5
6,688,660 B2 * 2/2004 Huang ..... 292/337
6,736,432 B2 * 5/2004 Huang et al. ..... 292/1.5
6,991,271 B2 * 1/2006 Chiang ..... 292/1.5
7,222,890 B2 * 5/2007 Yuan ..... 292/1.5
7,641,243 B2 * 1/2010 Yuan ..... 292/1.5
2003/0075930 A1 * 4/2003 Mak ..... 292/1.5
2003/0230903 A1 * 12/2003 Huang ..... 292/337
2004/0130162 A1 * 7/2004 Don et al. ..... 292/1.5
2004/0212199 A1 * 10/2004 Huang ..... 292/337

* cited by examiner

*Primary Examiner*—Peter M Cuomo
*Assistant Examiner*—Alyson M Merlino

(57) ABSTRACT

A latch assembly includes a latch bolt, a housing, an actuating plate connected with the latch bolt, a positioning casing, a lower connecting plate and an upper connecting plate engaged with each other and disposed in the positioning casing, and a driving plate disposed between the actuating plate and the lower connecting plate. The actuating plate is formed with a long slot and two symmetrical protrusions projected from the bottom. The driving plate includes a square hole, whose front end can be engaged with the protrusions and driving the actuating plate to move. The upper connecting plate includes two pairs of symmetrical recesses and the positioning casing includes two protrusions corresponding to the recesses of the upper connecting plate. By connecting the protrusions of the positioning casing with two pairs of the recesses, the latch assembly can be adjusted from a backset to the other backset dimension.

5 Claims, 4 Drawing Sheets

LATCH ASSEMBLY

BACKGROUND OF THE INVENTION

1. Field of the Invention

The present invention relates to a latch assembly, and in particular to a latch with an adjustable backset.

2. The Prior Arts

"Backset" refers to the distance from the edge of the door to the center of the pre-drilled hole for the lock. Most tubular locks come in a single size: 60 mm or 70 mm backset. The user needs to know the backset dimension to purchase the lock. If the lock purchased by the user has a backset different from the hole drilled on the door, the lock is unusable. Thus, the lock has only a single backset dimension is restricted to be used on the door having the pre-drilled hole with the same backset dimension. Accordingly, a latch assembly with an adjustable backset has been developed. The latch assembly can change the assembly method of transmission members of the lock and the backset distance can be set to one of two predetermined distances. The latch assembly according to the present invention is more applicable than the conventional latch assembly.

China Patent No. 99248490.1 discloses a "Latch bolt mechanism of a tubular lock with adjustable backset by an extension casing", which can be adjusted to provide two predetermined backset positions. The latch bolt mechanism includes a latch bolt housing, a plate assembly including a first plate and a second plate, an actuating plate, a follower plate located between the first plate and the second plate, and an extension casing mounted around an inner end of the plate assembly and movable longitudinally to the plate assembly. One end of the actuating plate includes a hook-shaped connecting member for retracting the latch bolt and the other end of the actuating plate includes an upper tooth and a lower tooth. The follower plate includes an upper tooth and a lower tooth, each of which includes a block formed thereon. When the spindle of the lockset is turned, one of the upper tooth and the lower tooth of the follower plate is pressed by a lateral side of the spindle. The follower plate presses the blocks of the actuating plate, and therefore the follower plate retracts the latch bolt. Moreover, the extension casing includes upper and lower slots in top and bottom sides thereof, respectively. The slots receive the blocks of the follower plate, respectively. Because the slots have a length longer than that of the blocks of the follower plate, the extension casing can drive the follower plate to move relative to the actuating plate and the extension casing can move relative to the follower plate, i.e. the extension casing and the follower plate can have different moving distance relative to the actuating plate. Thus, a latch of a tubular lock is adjusted to form two different backset dimensions by moving the extension casing. However, a disadvantage of this configuration is that this positioning mechanism of the latch bolt can not be adjusted accurately, because when the extension casing moves together with the follower plate between two backset dimensions, the relative moving space between the extension casing and the follower plate is realized by the slots of the extension casing that have a length longer than that of the blocks of the follower plate, and there is no position fixing member for the two different backset dimensions.

SUMMARY OF THE INVENTION

The objective of the present invention is to provide a latch assembly with an adjustable backset, by which the latch can be accurately set to one of two predetermined backset positions. The latch assembly can change from one backset dimension to the other back dimension quickly, conveniently and accurately.

A latch assembly according to the present invention includes a latch bolt, a housing, an actuating plate passing through the housing and connected with the latch bolt, a lower connecting plate connected with the housing and positioned under the actuating plate, an upper connecting plate positioned above the actuating plate, a driving plate mounted between the actuating plate and the lower connecting plate, and a positioning casing, in which the upper connecting plate combined with the lower connecting plate is placed.

The positioning casing is formed with a middle hole on the middle portion for a spindle to pass through, a front hole and a back hole on the front portion and back portion for fixing bolts to pass through respectively, and two protrusions symmetrically located on the left and right side of the middle hole.

The middle portion of the upper connecting plate is formed with a long hole for the spindle to pass through; a first pair of symmetrical recesses corresponding to the protrusions of the positioning casing is formed on both sides of the front portion of the long hole, and a second pair of symmetrical recesses corresponding to the protrusions of the positioning casing is formed on both sides of the back portion of the long hole.

The actuating plate is provided with a long slot along the length direction, and two symmetrical protrusions projecting from the left and right side of the middle portion of the bottom surface of the long slot.

The driving plate is formed with a square hole to allow the spindle to pass through, and the front side wall of the square hole is in contact with the protrusions of the actuating plate.

The upper connecting plate is provided with a first hole and a second hole at the front and back ends of the long hole respectively for the fixing bolt to pass through, and a third hole in the front portion of the upper connecting plate.

The lower connecting plate is provided with a long hole on the middle portion for the spindle to pass through, a first hole and a second hole on the front and back ends of the long hole for the fixing bolts to pass through, and a third hole in the front portion of the lower connecting plate.

When the protrusions of the positioning casing are engaged with the second pair of recesses of the upper connecting plate, the middle hole of the positioning casing is aligned with the long hole of the upper connecting plate, the long slot of the actuating plate and the long hole of the lower connecting plate; the front hole of the positioning casing is aligned with the first holes of the upper and lower connecting plates; the back hole of the positioning casing is aligned with the second holes of the upper and lower connecting plates.

When the protrusions of the positioning casing are engaged with the first pair of recesses of the upper connecting plate, the middle hole of the positioning casing is aligned with the long hole of the upper connecting plate, the long slot of the actuating plate, the square hole of the driving plate and the long hole of the lower connecting plate; the front hole of the positioning casing is aligned with the third holes of the upper and lower connecting plates; the back hole of the positioning casing is aligned with the long holes of the upper and lower connecting plates.

The latch assembly of the present invention can be set to two different backset dimensions by configuring the positioning casing, the driving plate and the upper and lower connecting plates without other tool. A larger backset dimension can be obtained by connecting the protrusions of the positioning casing with the second pair of recesses of the upper connecting plate, and a smaller backset dimension can be obtained by connecting the protrusions of the positioning casing with the first pair of recesses of the upper connecting plate. When the larger backset dimension is employed, the spindle is engaged with the actuating plate to retract the latch bolt. When the smaller backset dimension is employed, the spindle is engaged with the driving plate to retract the latch bolt. The latch assembly according to the present invention is configured simply and can be adjusted from a backset dimension to the other backset dimension easily and accurately.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

A preferred embodiment in accordance with the present invention will now be described with reference to the accompanying drawings.

Figure 1:
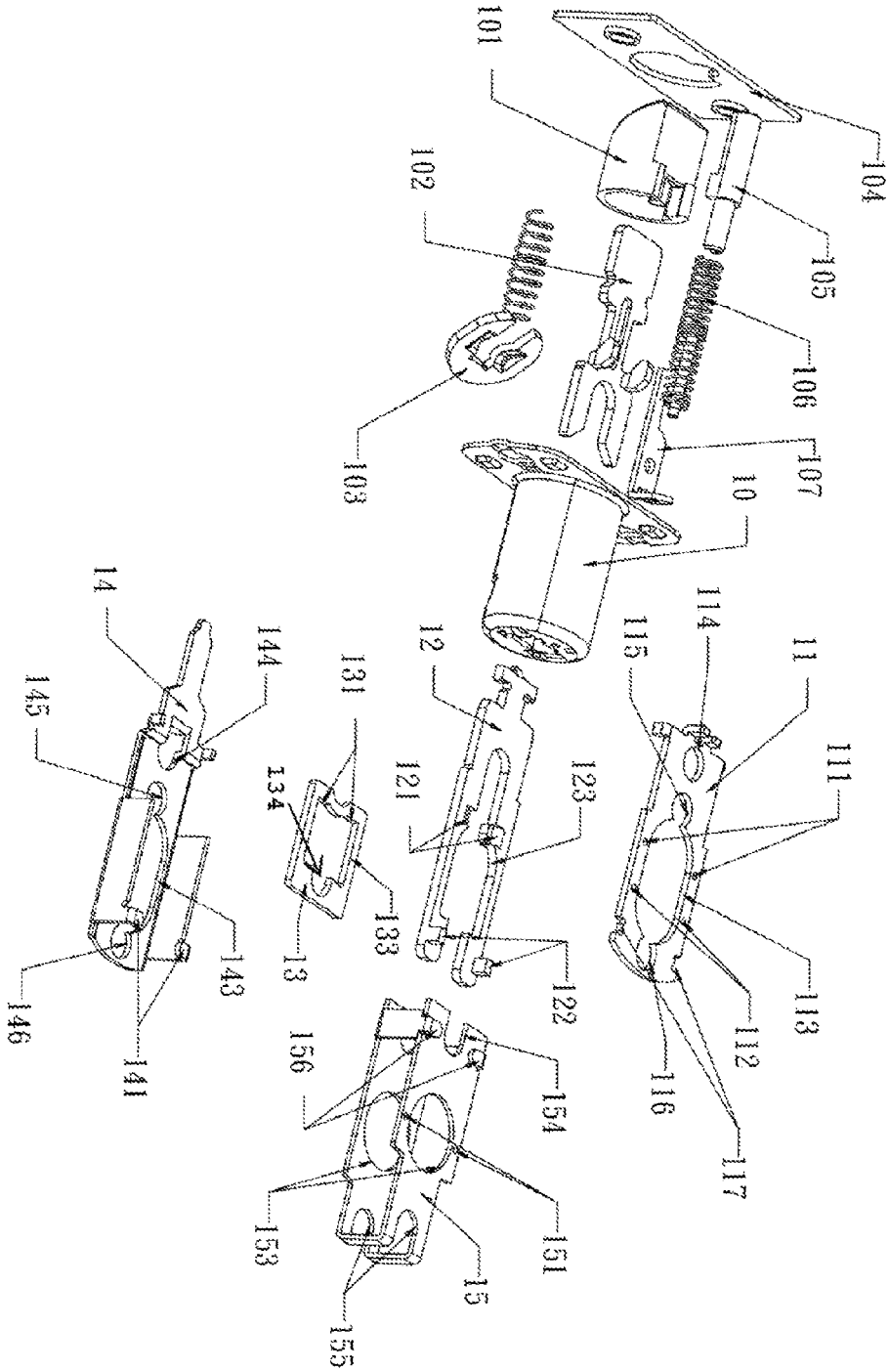
FIG. 1 is an exploded perspective view showing a latch assembly according to an embodiment of the present invention.

With reference to FIG. 1, a latch assembly according to the present invention includes a housing assembly, an upper connecting plate 11, a lower connecting plate 14, an actuating plate 12, a driving plate 13 and a positioning casing 15.

The housing assembly includes a housing 10, a latch bolt 101, a linking member 102, a clip plate 103, a face plate 104, an anti-theft pin 105, an elastic element 106 and a guarding plate 107. The latch bolt 101 is connected with the linking member 102. The linking member 102 is connected with the clip plate 103 and can be driven by the actuating plate 12.

Figure 2:
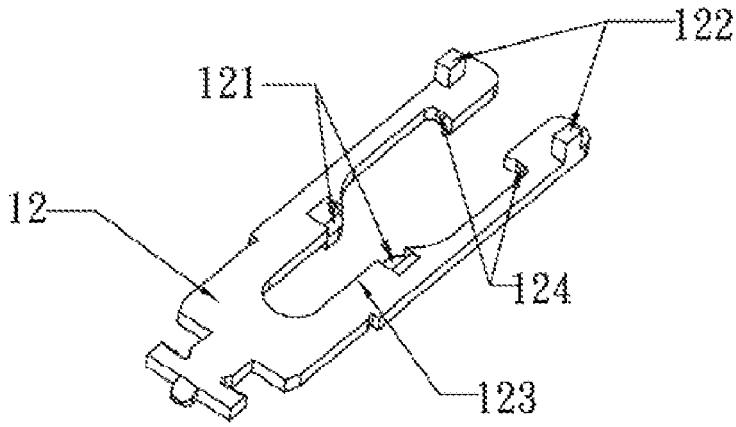
FIG. 2 is a schematic view showing an actuating plate of the latch assembly according to the embodiment of the present invention.

Referring to FIGS. 1 and 2, the actuating plate 12 includes a hook at one end, which is connected with the linking member 102 in the housing 10 by means of the clip plate 103 for driving the latch bolt 101 to move. The actuating plate 12 is disposed between the upper connecting plate 11 and the lower connecting plate 14. A long slot 123 formed on the actuating plate 12 along the length direction includes an assembly plane 124 on the side surface thereof, which can be engaged with a rotating plane 164 of a spindle 163 (referring to FIG. 4). The back end of the long slot 123 has a notch for receiving the spindle 163. On the left and right sides of the middle portion of the long slot 123, two first protrusions 121 are formed symmetrically, which are projected from the bottom surface of the actuating plate 12. The other end of the actuating plate 12 opposing to the hook is provided with two second protrusions 122 symmetrically formed on the edges of the actuating plate 12, which can be tightly contacted with the upper connecting plate 11 disposed above the actuating plate 12 for preventing the actuating plate 12 from shaking.

One end of the lower connecting plate 14 is connected with the housing 10. A long hole 143 is formed in the middle portion of the lower connecting plate 14 to allow the spindle 163 to pass through (Referring to FIGS. 4 and 6). The lower connecting plate 14 also includes a first hole 145 and a second hole 146 located at the front and back ends of the long hole 143 respectively for the fixing bolts to pass through, and a third hole 144 located at the front portion of the lower connecting plate 14. Furthermore, the lower connecting plate 14 is provided with two symmetrical clamping blocks 141 on the two long edges respectively for engaging the lower connecting plate 14 with the upper connecting plate 11.

Figure 3:
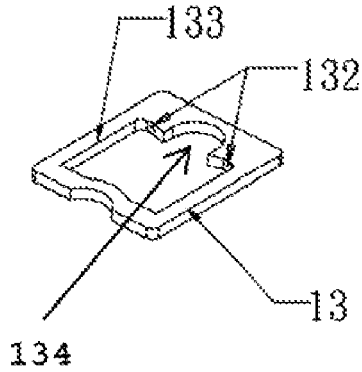
FIG. 3 is a schematic view showing a driving plate of the latch assembly according to the embodiment of the present invention.

Referring to FIGS. 1 and 3, the driving plate 13 is a thin flat piece and is disposed between the actuating plate 12 and the lower connecting plate 14. The driving plate 13 is formed with a square hole 133 for the spindle 13 to pass through. Also, the square hole 133 includes a semicircular hole 134 corresponding to the spindle 163 on the back end thereof. The front side wall of the square hole 133 includes a first assembly plane 131 and the back side wall of the square hole 133 includes a second assembly plane 132. The first assembly plane 131 can be engaged with the first protrusions 121 of the actuating plate 12 for driving the actuating plate 12 to move.

The upper connecting plate 11 having the configuration corresponding to the lower connecting plate 14 is provided with a long hole 113 formed in the middle portion thereof. The spindle 163 passes through the long hole 113. The upper connecting plate 11 is also provided with a first hole 115 and a second hole 116 located at front and back ends of the long hole 113 respectively for the fixing bolts to pass through. Also, the upper connecting plate 11 is formed with a third hole 114 at the front portion thereof. A first pair of symmetrical recesses 111 and a second pair of symmetrical recesses 112 are formed at the two sides of the long hole 113. The second pair of symmetrical recesses 112 is positioned at the back portion of the upper connecting plate 11 and the first pair of symmetrical recesses 111 is positioned at the back portion of the upper connecting plate 11. Furthermore, the upper connecting plate 11 is formed with two symmetrical notches 117 corresponding to the clamping blocks 141 of the lower connecting plate 14 on the two edges thereof. The upper connecting plate 11 is assembled with the lower connecting plate 14 by engaging the clamping blocks 141 with the notches 117.

The upper and lower connecting plates 11, 14, the actuating plate 12 and the driving plate 13 are connected together and are disposed in the positioning casing 15. The positioning casing 15 is formed with a middle hole 153 for the spindle 163 to pass through, and is also formed with a front hole 154 and a back hole 155 for the fixing bolts to pass through. Also, two protrusions 151 are formed on the left and right sides of the middle hole 153, respectively. The protrusions 151 can be engaged with the first pair of recesses 111 or the second pair of recesses 112. One end of the positioning casing 15 is provided with two assembly blocks 156 symmetrically placed on the edges for fixing the positioning casing 15.

For assembling the latch assembly, the lower connecting plate 14 is installed in the housing 10 first, and then the actuating plate 12 is installed. In the housing 10, the actuating plate 12 is connected with the linking member 102 and the clip plate 103 to drive the latch bolt 101 to move. Afterward, the driving plate 13 is installed between the actuating plate 12 and the lower connecting plate 14. The first assembly plane 131 of the driving plate 13 is engaged with the first protrusions 121 of the actuating plate 12, whereby the driving plate 13 can drive the actuating plate 12 to unlock the lock. Then the upper connecting plate 11 is installed by engaging the clamping blocks 141 of the lower connecting plate 14 with the notches 117 of the upper connecting plate 11. Meanwhile, the second protrusions 122 of the actuating plate 12 are in contact with the upper connecting plate 11 tightly for preventing the actuating plate 12 from shaking. Finally, the outside of the upper connecting plate 11 and the lower connecting plate 14 is covered with the positioning casing 15, and then the assembly blocks 156 are riveted. Thus the assembly process of the latch is completed.

Figure 4:
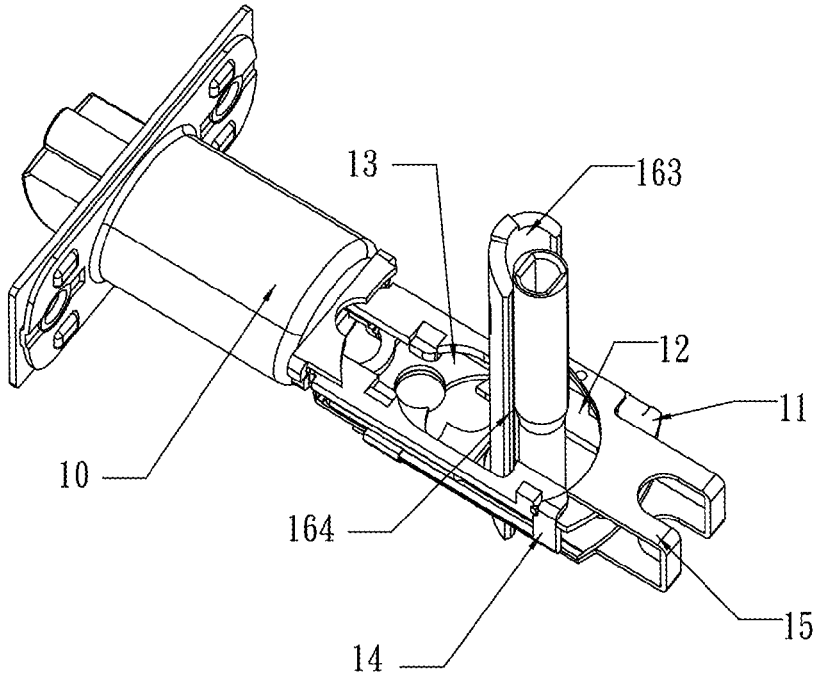
FIG. 4 is a schematic view showing the latch assembly assembled with a spindle in a first backset dimension.
Figure 5:
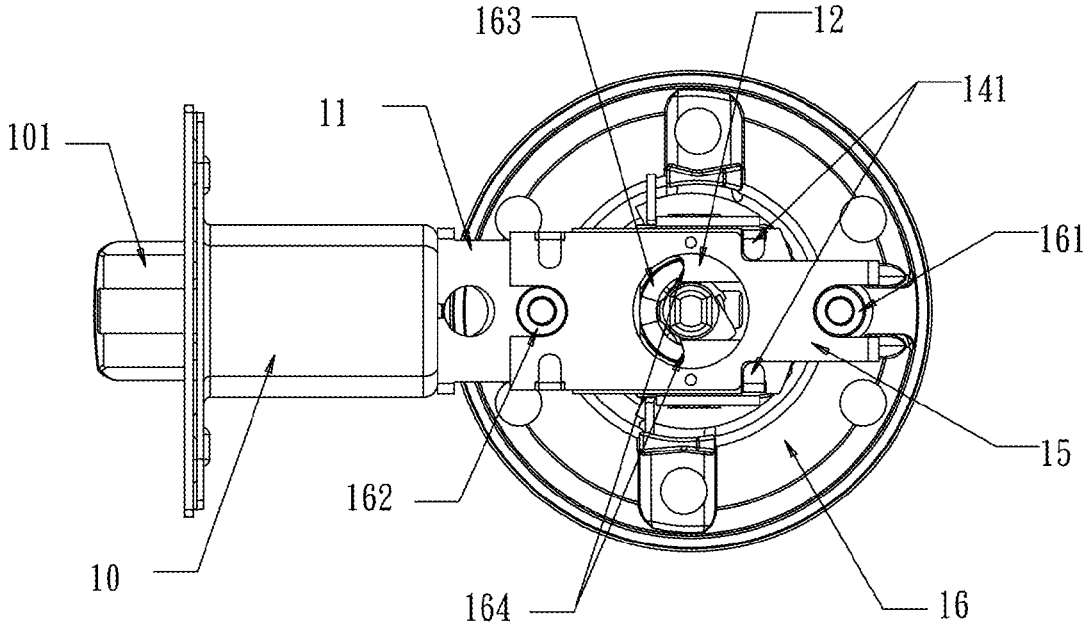
FIG. 5 is a schematic view showing an initial state of the latch assembly employing the first backset dimension.

FIG. 4 is a schematic view showing the latch assembly assembled with the spindle 163 in a first backset dimension. When the latch assembly according to the present invention is adjusted to a larger backset dimension, the positioning casing 15 is moved to engage the protrusions 151 of the positioning casing 15 with the second pair of recesses 112 of the upper connecting plate 11. In assembling the lock body 16, the spindle 163 passes through the middle hole 153 of the positioning casing 15, the long hole 143 of the lower connecting plate 14, the long slot 123 of the actuating plate 12 and the long hole 113 of the upper connecting plate 11 so that the rotating plane 164 of the spindle 163 can engage with the assembly plane 124 of the actuating plate 12. It is important to note that as shown in FIG. 4, the spindle 163 is positioned behind the driving plate 13 without passing through the semicircular hole 134. When the spindle 163 is turned, the rotating plane 164 presses the assembly plane 124 and then drives the actuating plate 12 to move. Thus, the latch bolt 101 is driven by the hook of the actuating plate 12 to retract to the housing 10. Moreover, referring to FIG. 5, a first fixing bolt 161 passes through the back hole 155 of the positioning casing 15, the second hole 146 of the lower connecting plate 14 and the second hole 116 of the upper connecting plate 11. Also, a second fixing bolt 162 passes through the front hole 154 of the positioning casing 15, the first hole 145 of the lower connecting plate 14 and the first hole 115 of the upper connecting plate 11. Accordingly, the lock body 16 can be fixed.

Figure 6:
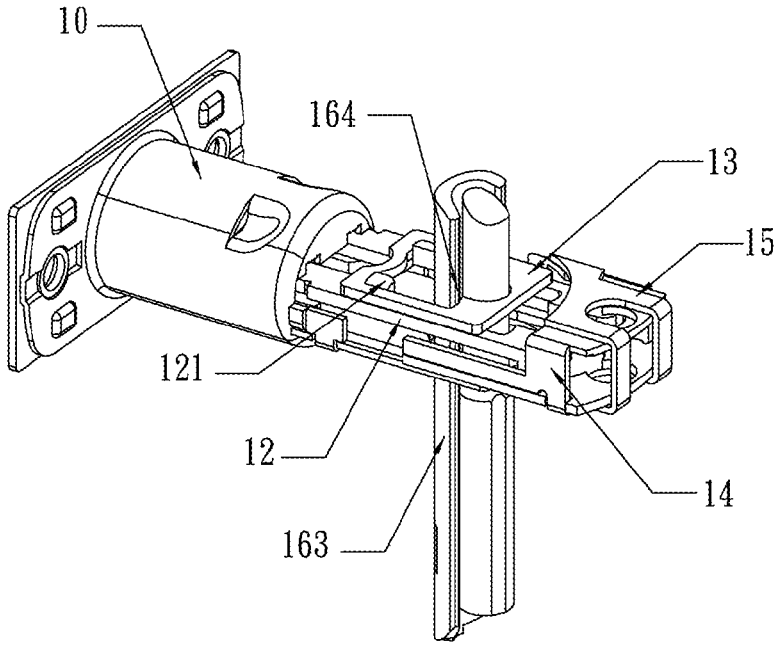
FIG. 6 is a schematic view showing the latch assembly assembled with the spindle in a second backset dimension.
Figure 7:
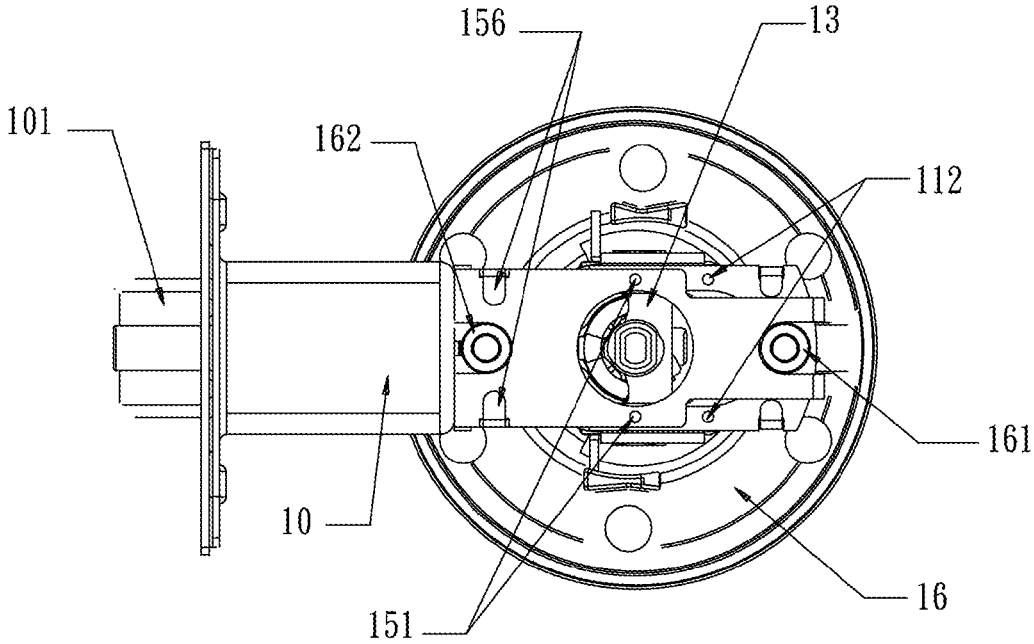
FIG. 7 is a schematic view showing the initial state of the latch assembly employing the second backset dimension.

FIG. 6 is a schematic view showing the latch assembly assembled with the spindle 163 in a second backset dimension. When the latch assembly according to the present invention is adjusted to a smaller backset dimension, the positioning casing 15 is moved to engage the protrusions 151 of the positioning casing 15 with the first pair of recesses 111 of the upper connecting plate 11. In assembling the lock body 16, the spindle 163 passes through the middle hole 153 of the positioning casing 15, the long hole 143 of the lower connecting plate 14, the semicircular hole 134 in back of the square hole 133 of the driving plate 13, the long slot 123 of the actuating plate 12 and the long hole 113 of the upper connecting plate 11 so that the rotating plane 164 of the spindle 163 can engage with the second assembly plane 132 of the driving plate 13. Meanwhile, the first assembly plane 131 of the driving plate 13 is engaged with the first protrusions 121 of the actuating plate 12. When the spindle 163 is turned, the rotating plane 164 presses the second assembly plane 132 and then drives the driving plate 13 to move. Thus, the driving plate 13 drives the actuating plate 12 and the hook of the actuating plate 12 retracts the latch bolt 101 back into the casing. Moreover, referring to FIG. 7, the first fixing bolt 161 passes through the back hole 155 of the positioning casing 15, the long hole 143 of the lower connecting plate 14 and the long hole 113 of the upper connecting plate 11. Also, the second fixing bolt 162 passes through the front hole 154 of the positioning casing 15, the third hole 144 of the lower connecting plate 14 and the third hole 114 of the upper connecting plate 11. Accordingly, the lock body 16 is fixed.

From above all, the latch according to the present invention can be set to two backset dimensions without any tools. The latch assembly can be accurately kept at the predetermined backset dimension and can prevent the backset dimension from being unintentionally changed to other dimensions. Therefore, the latch assembly according to the present invention has a simple structure and can adjust the backset dimension conveniently.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A latch assembly, comprising:

a latch bolt;

a housing;

a spindle;

two fixing bolts;

a lower connecting plate connected with the housing and having a lower long hole formed on a middle portion of the lower connecting plate for the spindle to pass through, a first hole and a second hole formed on front and back ends of the lower long hole for the fixing bolts to pass through, and a third hole formed on a front portion of the lower connecting plate;

an upper connecting plate having an upper long hole formed on a middle portion of the upper connecting plate for the spindle to pass through, a first pair of symmetrical recesses located near two edges of the upper connecting plate across a front portion of the upper long hole, a second pair of symmetrical recesses located near the two edges across a back portion of the upper long hole, a first hole and a second hole formed on front and back ends of the upper long hole for the fixing bolts to pass through, and a third hole formed on a front portion of the upper connecting plate;

an actuating plate between the upper and lower connecting plates, the actuating plate passing through the housing, connected with the latch bolt, and having a long slot along a longitudinal direction of the actuating plate with two lower symmetrical protrusions projected from a bottom surface on two edges of a middle portion of the long slot towards the lower connecting plate;

a driving plate mounted between the actuating plate and the lower connecting plate, the driving plate having a square hole for the spindle to pass through, and the two lower protrusions of the actuating plate being received in the square hole with a front side wall of the square hole in contact with the lower protrusions of the actuating plate; and a positioning casing in which the upper connecting plate assembled with the lower connecting plate is disposed, the positioning casing having a middle hole on a middle portion thereof for the spindle to pass through, a front hole and a back hole on front and back ends for the two fixing bolts to respectively pass through and two protrusions formed near two edges on the positioning casing across from one another on either side of the middle hole for engaging with the first or second pair of symmetrical recesses of the upper connecting plate;

wherein when the protrusions of the positioning casing are engaged with the second pair of recesses of the upper connecting plate, the middle hole of the positioning casing is aligned with the upper long hole of the upper connecting plate, the long slot of the actuating plate and the lower long hole of the lower connecting plate, and the front hole of the positioning casing is aligned with the first hole of the upper connecting plate and the first hole of the lower connecting plate to position the spindle behind the driving plate so that the spindle does not pass through the square hole so that when the spindle is rotated, it will directly move the actuating plate in order to retract the latch bolt; and when the protrusions of the positioning casing are engaged with the first pair of recesses of the upper connecting plate, the middle hole of the positioning casing is aligned with the upper long hole of the upper connecting plate, the long slot of the actuating plate, the square hole of the driving plate and the lower long hole of the lower connecting plate for the spindle to pass through the square hole so that when the spindle is rotated, it will directly move the driving plate to move the actuating plate in order to retract the latch bolt, and the front hole of the positioning casing is aligned with the third hole of the upper connecting plate and the third hole of the lower connecting plate.

2. The latch assembly as claimed in claim 1, wherein the lower connecting plate further comprises two symmetrical clamping blocks formed on two edges near a back end of the lower connecting plate.

3. The latch assembly as claimed in claim 1, wherein the upper connecting plate further comprises two symmetrical notches formed on two edges near a back end of the upper connecting plate for engaging with the clamping blocks of the lower connecting plate.

4. The latch assembly as claimed in claim 1, wherein the actuating plate further comprises two upper symmetrical protrusions projected from a top surface on two edges near a back end of the actuating plate towards the upper connecting plate to tightly contact the upper connecting plate.

5. The latch assembly as claimed in claim 1, wherein the driving plate further comprises a semicircular hole extended from a back side of the square hole for engaging with the spindle when the protrusions of the positioning casing are engaged with the first pair of recesses of the upper connecting plate.

* * * * *